United States Patent [19]

Dawson

[11] Patent Number: 4,793,006

[45] Date of Patent: Dec. 27, 1988

[54] VISOR CAP WITH MOVABLE PROTECTIVE VISOR

[76] Inventor: William O. Dawson, 267 Longpointe Ct., Vero Beach, Fla. 32966

[21] Appl. No.: 155,991

[22] Filed: Feb. 16, 1988

[51] Int. Cl.[4] ..... A42B 1/06

[52] U.S. Cl. ..... 2/191; 2/10; 2/175; 2/185 R; 2/195; 2/199

[58] Field of Search ..... 2/10, 12, 177, 180, 2/191, 195, 196, 199

[56] References Cited

U.S. PATENT DOCUMENTS

| | | | |
|---|---|---|---|
| 566,326 | 8/1896 | Kirshner | 2/195 |
| 1,610,745 | 12/1926 | Castanaro | 2/10 |
| 2,004,471 | 6/1935 | David | 2/10 |
| 3,837,005 | 9/1974 | Persson | 2/10 |

*Primary Examiner*—Werner H. Schroeder

*Assistant Examiner*—Jeanette E. Chapman

*Attorney, Agent, or Firm*—Marshall, O'Toole, Gerstein, Murray & Bicknell

[57] ABSTRACT

A cap to be worn on the head of a person, comprising a generally hemispherical shell, having a lower edge, which fits over the upper portion of the head of a person; a permanent visor attached to that portion of the shell lower edge which contacts the forehead and extending outwardly therefrom; an extendible visor having essentially the same shape as the visor and movable from a stored position where it mates with the permanent visor to a forward extended position at which it effectively increases the length of the permanent visor; and one or more fasteners which releasably secure the extendible visor in stored mating position against one side of the permanent visor and which releasably secure the extendible visor in forward extended position against one side of the permanent visor.

2 Claims, 2 Drawing Sheets

VISOR CAP WITH MOVABLE PROTECTIVE VISOR

This invention relates to peak or visor caps worn by humans.

BACKGROUND OF THE INVENTION

Peak or visor caps are widely worn by golfers, baseball players, hunters and farm workers. These caps have a generally hemisherical shell which fits over the upper portion of the head. The lower edge of the shell extends down close to the top of the ears. A visor or peak, attached to the shell lower edge, extends forward normally about two and one-half to four inches, with three inches about average. The visor usually has a width of about six to eight inches, with seven inches about average. The cap shell is usually made of cloth, which can be insulated for warmth, or partially or wholly of an open mesh material for wear in warm climates where ventilation is desirable. The visor is often made of one or more layers of cloth sewn together, with or without an internal sheet of cardboard or other stiffening material.

The purpose of the visor is to protect the wearers face against excessive sunlight which can cause sunburn and harm the eyes. The visor is also intended to protect the face and eyes against rain. While the normal visor generally provides acceptable protection against the described elements there are times when the visor is not long enough to provide the desired protection, such as when it rains heavily and the ordinary visor does not adequately protect the face and eyeglasses. Also, early in the morning and late in the day when the sun is low in the sky, ordinary visors do not provide the desired amount of shade to protect the eyes.

Castanaro U.S. Pat. No. 1,610,745 discloses a cap with a permanent visor having an extendible visor in a pocket between two adjacent layers forming the permanent visor. Flexible strips or cords limit forward or outward movement of the extendible visor. However, no mechanical means is provided to maintain the extendible visor in any specific fixed inward or outward position so that it can slide in or out at an inappropriate time. There is a need, accordingly, for an improved visor cap, which provides additional protection against the elements during such adverse conditions having an extendible visor which can securely hold it in stored and outward positions.

SUMMARY OF THE INVENTION

According to the invention a cap is provided to be worn on the head of a person, comprising a generally hemispherical shell, having a lower edge, which fits over the upper portion of the head of a person; a permanent visor attached to that portion of the shell lower edge which contacts the forehead and extending outwardly therefrom; an extendible visor having essentially the same shape as the visor and movable from a stored position where it mates with the permanent visor to a forward extended position at which it effectively increases the length of the permanent visor; and fastener means which releasably secures the extendible visor in stored mating position against one side of the permanent visor and which releasably secures the extendible visor in forward extended position against one side of the permanent visor.

The fastener means can include first elements on the permanent visor and second elements on the extendible visor, with at least some of the second elements on the extendible visor cooperating with some of the first elements on the permanent visor to secure the extendible visor in stored position and to secure it in the extended position.

The fastener means can be snaps having male and female elements and when one of the first and second elements is a male element the other element is a female element.

In another embodiment of the invention, the permanent visor can have an elastic band lateral to and extending across at least one side of the permanent visor; the extendible visor can be located between the permanent visor and the elastic band; the fastener means can include two parallel pair of lateral notches; a first pair of the laterally opposing notches can be located along the edges of the extendible visor, with said notches engageable with the elastic band when the extendible visor is in stored position mating with the permanent visor; a second pair of the laterally opposing notches can be located along the edges of the extendible visor, with said notches engageable with the elastic band when the extendible visor is in forward extended position; and the first pair of notches can be located on the extendible visor forward of the second pair of notches. The notches and the band desirably have approximately the same width.

The described embodiments of the invention keep the extendible visor in fixed stored or forward and extended position so that the extendible visor is not unintentionally dislodged from either position.

DETAILED DESCRIPTION OF THE DRAWINGS

To the extent it is reasonable and practical, the same or similar elements appearing in the various views of the drawings will be identified by the same numbers.

Figure 1:
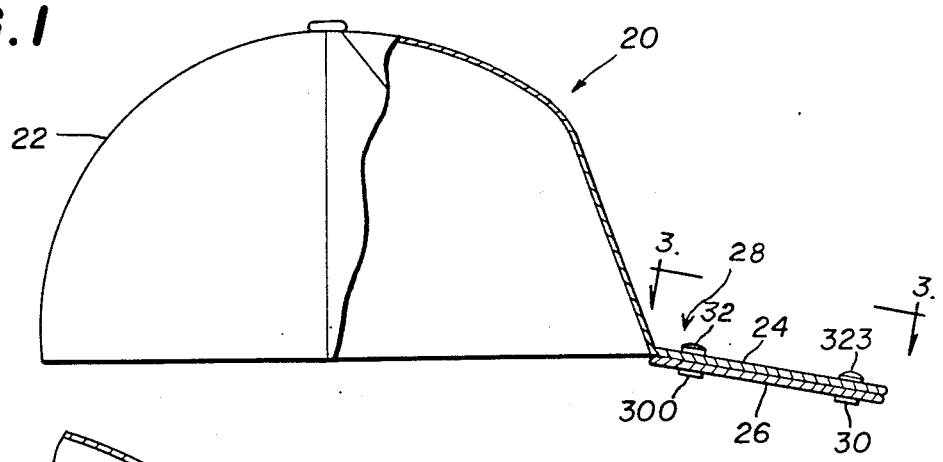
FIG. 1 is a side elevation, partially broken away and in section, of one embodiment of cap provided by the invention with an extendible visor in stored position.
Figure 2:
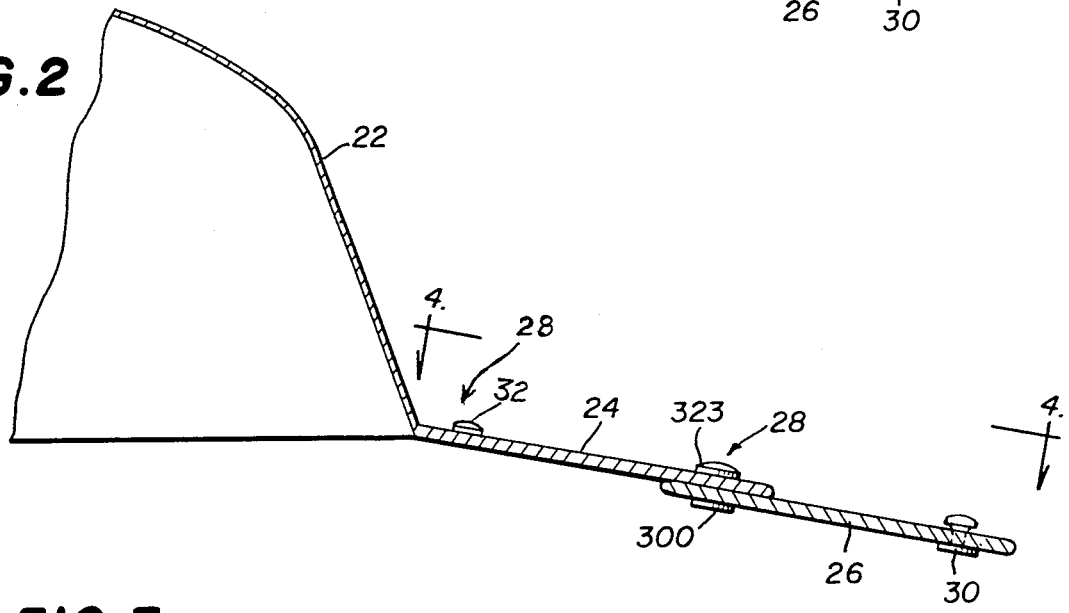
FIG. 2 is a sectional view of the cap shown in FIG. 1 but with the extendible visor in extended position.
Figure 3:
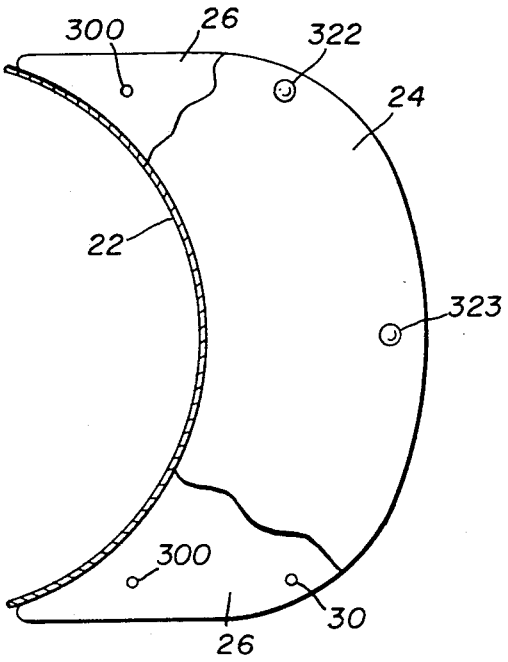
FIG. 3 is a view taken along the line 3—3 of FIG. 1.
Figure 4:
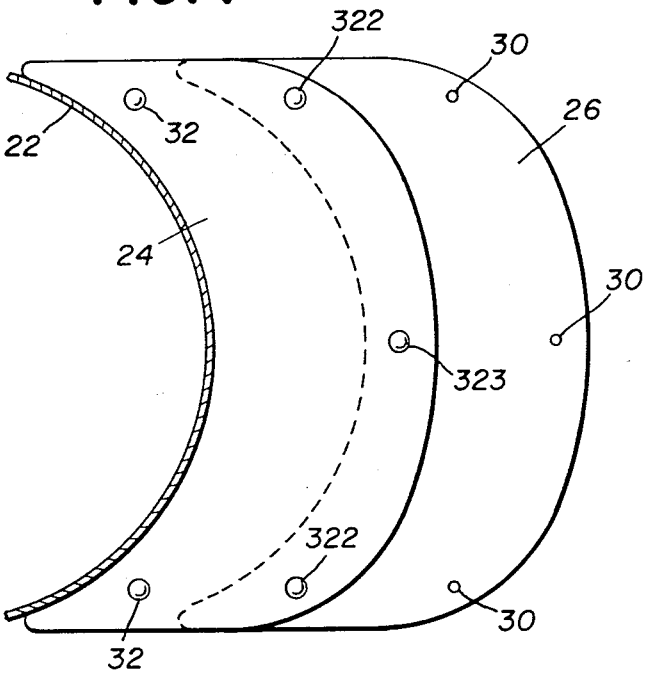
FIG. 4 is a view taken along the line 4—4 of FIG. 2.
Figure 5:
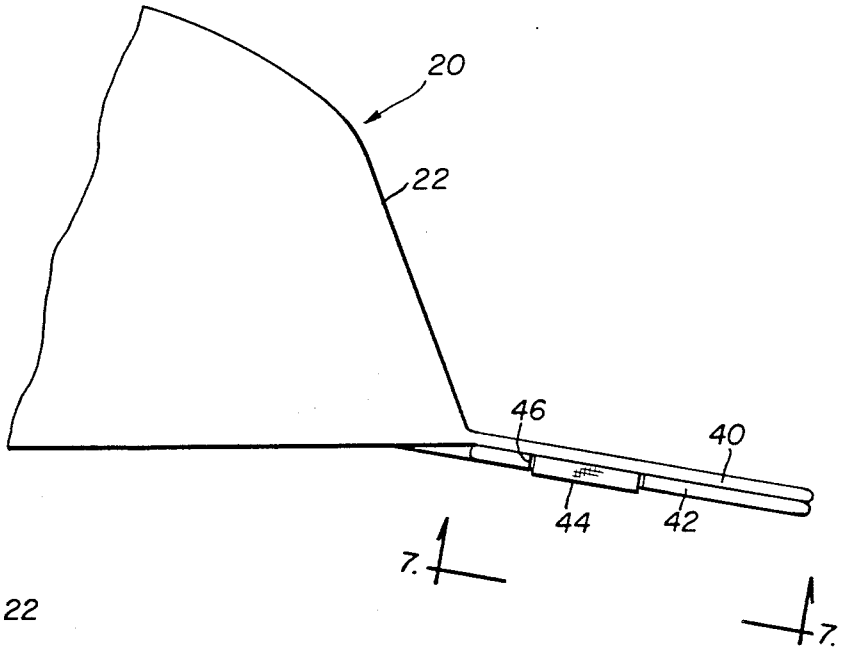
FIG. 5 is a partial side elevational view of a second embodiment of cap provided by the invention showing the extendible visor in stored position.
Figure 6:
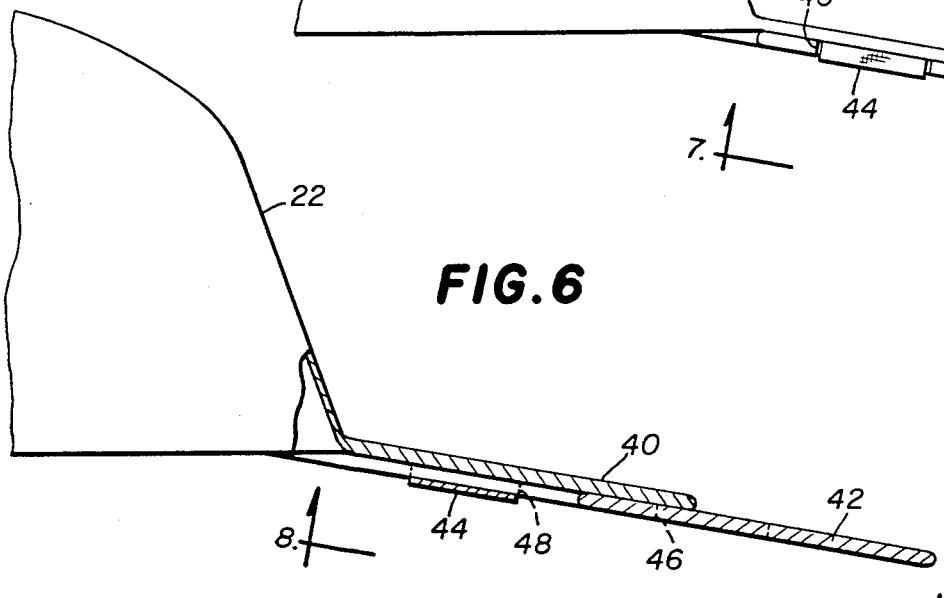
FIG. 6 is similar to FIG. 5 but shows the extendible visor in extended position.
Figure 7:
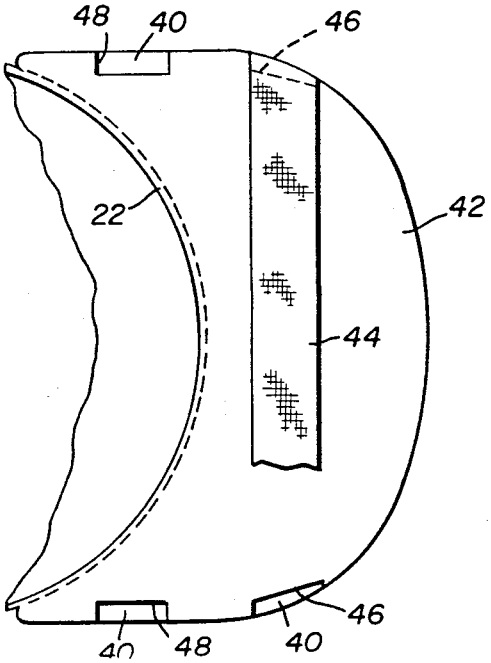
FIG. 7 is a view taken along the line 7—7 of FIG. 5.
Figure 8:
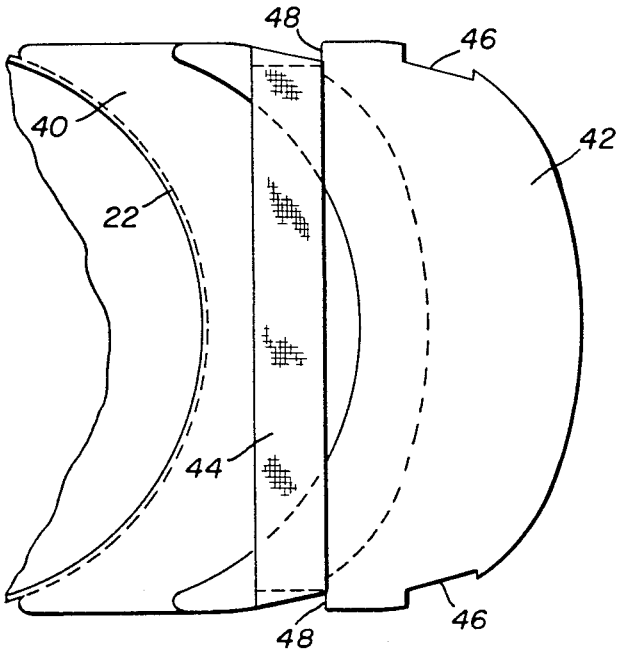
FIG. 8 is a view taken along the line 8—8 of FIG. 6.

The cap 20 shown in FIGS. 1 and 2 has a generally hemispherical shell 22 made of any suitable material, but desirably of woven cotton cloth. A permanent visor or peak 24 is attached to the front end of shell 22 by suitable means, such as a sewn seam. The length and width of the permanent visor 24 can vary but generally the length is about two and one-half to four inches and the width is about six to eight inches.

An extendible visor 26 when in stored position is releasably fastened directly beneath and to the permanent visor 24 by suitable fastening means. In the embodiment shown in FIGS. 1 to 4 the fastening means are conventional snaps 28. The male portions 30, 300 of the snaps 28 are located so as to extend up from tee top side of the extendible visor 26. The single male snap portion 30 is located in the front center of extendible visor 26 and two male snap portions 300 are located n the rear corners of the extendible visor but they are positioned to be close to the cap shell 22 when the extendible visor is in stored position.

The permanent visor 24 is provided with five identical female portions with two of them numbered 32, two of them numbered 322 and one numbered 323. The two female portions 32 are located in the rear corners of the permanent visor close to the cap shell 22. The two female portions 32 mate with the two male portions 300. The two female portions 322 are located in the two forward corner portions of the permanent visor 24 and mate with the two male portions 300 when the extendible visor is in extended position. The permanent visor 24 also has a forwardly located and centered female snap portion 323 positioned to engage male snap portion 30 when the extendible visor is in stored position.

The extendible visor 26 has a size and shape corresponding essentially to that of the permanent visor 24. Thus, when the extendible visor 26 is in stored position it is effectively hidden from view.

To place the extendible visor 26 in extended position, the extendible visor 26 is first detached from stored position by releasing the three snaps 32,32,323. Then the extendible visor 26 is positioned in extended position by attaching the two inner male snap portions 300 to the two female snap portions 322 which are spaced apart the most. This effectively increases the overall length of the visor from about one and one-half to three inches depending on the length of each of the permanent and extendible visors and the position of each relative to the other when the extendible visor is in extended position. When the extendible visor 26 is no longer needed, it can be placed in stored position by reversing the described procedure.

Although the snaps are shown with the male portions on the extendible visor 26 and the female portions on the permanent visor 24 they can be reversed, if desired, by placing the female portions on the extendible visor and the male portions on the permanent visor.

FIGS. 5 to 8 illustrate a second embodiment of the invention. In this embodiment an extendible visor 42 is movably positioned beneath permanent visor 40 by means of an elastic strap or band 44.

The opposing ends of band 44 are attached to the bottom surface of permanent visor 40 along the lateral side edges thereof. If desired, the band 44 can be a closed loop and extend laterally around the permanent visor 40.

The extendible visor 42 has a pair of forward opposing slots 46 located along its side edges. The extendible visor 42 also has a pair of rearward opposing slots 48 located along its side edges. The slots 46 are located in a line parallel to a line through the slots 48. Furthermore, the slots 46,48 have a width slightly larger than the width of band 44.

To position the extendible visor 42 in stored position beneath permanent visor 40, the extendible permanent visor 40 is first bent down slightly and then the extendible visor 42 is inserted under the elastic band 44 with the narrowest width of the extendible visor forward. Then the extendible visor is rotated until the band is positioned in both slots 46.

To position the extendible visor 42 in extended position on the cap, the extendible visor is first removed from stored position by bending the permanent visor 40 down and sliding the extendible visor out from the rear. Then, with the permanent visor bent down, the extendible visor 42 is slid from the front between the band 44 and the permanent visor 40 with rotation of the extendible visor so as to position band 44 in slots 48. The band is all that is needed to hold the extendible visor in extended position on the cap. When it is not needed, it can be returned to stored position by reversing the described procedures.

The extendible visor 42 has essentially the same size and shape as the permanent visor 40 so that when the extendible visor is in stored position the cap appears to have only a single visor. However, even when the extendible visor 42 is in extended position, the cap has a neat, pleasant dressy appearance.

It is also feasible to use a velcro type of fabric to attach the extendible visor to the permanent visor in stored and extended position. Such an attachment means permits the extendible visor to be attached in varying positions from stored position to a maximum extendible position and all positions between these extremes.

The cap of this invention is readily manufactured, low cost and highly effective in protecting the wearer against adverse environmental elements.

The foregoing detailed description has been given for clearness of understanding only, and no unnecessary limitations should be understood therefrom, as modifications will be obvious to those skilled in the art.

What is claimed is:

1. A cap to be worn on the head of a person, comprising:

a generally hemispherical shell, having a lower edge, which fits over the upper portion of the head of a person;

a permanent visor attached to that portion of the shall lower edge which contacts the forehead and extending outwardly therefrom;

the permanent visor having an elastic band lateral to and extending across at least one side of the permanent visor;

an extendible visor having essentially the same shape as the permanent visor and movable from a stored position where it mates with the permanent visor to a forward extended position at which it effectively increases the length of the permanent visor;

the extendible visor being located between the permanent visor and the elastic band;

fastener means which releasably secures the extendible visor in stored mating position against one side of the permanent visor and which releasably secures the extendible visor in forward extended position against one side of the permanent visor;

the fastener means including two parallel pair of lateral notches;

a first pair of the laterally opposing notches being located along the edges of the extendible visor, with said notches engageable with the elastic band when the extendible visor is in storage position mating with the permanent visor;

a second pair of the laterally opposing notches being located along the edges of the extendible visor, with said notches engageable with the elastic band when the extendible visor is in forward extended position; and the first pair of notches being located on the extendible visor forward of the second pair of notches.

2. A cap according to claim 1 in which the notches and the band have approximately the same width.

* * * * *